US007954526B2

(12) United States Patent
Chen

(10) Patent No.: US 7,954,526 B2
(45) **Date of Patent: *Jun. 7, 2011**

(54) GOLF CLUB HEAD COVER

(75) Inventor: Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/549,310

(22) Filed: Aug. 27, 2009

(65) Prior Publication Data

US 2009/0314399 A1 Dec. 24, 2009

Related U.S. Application Data

(63) Continuation of application No. 11/193,098, filed on Jul. 29, 2005, now Pat. No. 7,597,126.

(51) Int. Cl.
*B65D 65/02* (2006.01)

(52) U.S. Cl. ..... 150/160; 206/818

(58) Field of Classification Search ..... 150/160; 206/818

See application file for complete search history.

(56) References Cited

U.S. PATENT DOCUMENTS

| | | | | |
|---|---|---|---|---|
| 3,861,434 | A | 1/1975 | Harding | |
| 3,938,570 | A | 2/1976 | Stewart | |
| 4,667,716 | A | 5/1987 | Solheim | |
| 4,858,361 | A * | 8/1989 | White | 42/96 |
| 5,005,624 | A | 4/1991 | Sung | |
| 5,146,968 | A | 9/1992 | Meek | |
| 5,437,320 | A | 8/1995 | Sung | |
| 6,095,214 | A | 8/2000 | Gaffney | |
| 6,119,742 | A | 9/2000 | Maeng | |
| 6,202,723 | B1 | 3/2001 | Maeng | |
| D444,525 | S | 7/2001 | Bernath | |
| D447,202 | S | 8/2001 | Besnard et al. | |
| 6,321,805 | B1 | 11/2001 | Suggs | |
| 7,597,126 | B2 * | 10/2009 | Chen | 150/160 |
| 2004/0173484 | A1 * | 9/2004 | Bates et al. | 206/349 |
| 2005/0016648 | A1 | 1/2005 | Vakharia et al. | |

FOREIGN PATENT DOCUMENTS

| | | |
|---|---|---|
| GB | 2327363 | 1/1999 |
| JP | 2003225335 A | 8/2003 |
| JP | 2003265662 A | 9/2003 |

* cited by examiner

*Primary Examiner* — Tri M Mai

(57) ABSTRACT

Embodiments of golf club head covers are described herein. Other embodiments and related examples comprising magnetic elements are also described herein.

20 Claims, 1 Drawing Sheet

GOLF CLUB HEAD COVER

CROSS REFERENCE TO RELATED APPLICATIONS

This application is a continuation of U.S. patent application Ser. No. 11/193,098, filed Jul. 29, 2005 now U.S. Pat. No. 7,597,126. The disclosure of the application above is incorporated herein by reference.

FIELD OF THE INVENTION

This invention relates generally to sports equipment, and relates, more particularly, to golf club head covers.

BACKGROUND

Proper care of golf clubs is required both to maximize their usable life and to maintain their performance. An important aspect of proper care includes protecting golf club heads from damage due to impact with other golf club heads or exposure to environmental elements when not in use. Thus, head covers are widely used for certain types of golf clubs such as putters and woods. However, many prior head covers have used either no fastening devices or fastening devices that malfunction thereby hindering their effective use and/or discouraging their frequent use.

DETAILED DESCRIPTION

Figure 1:
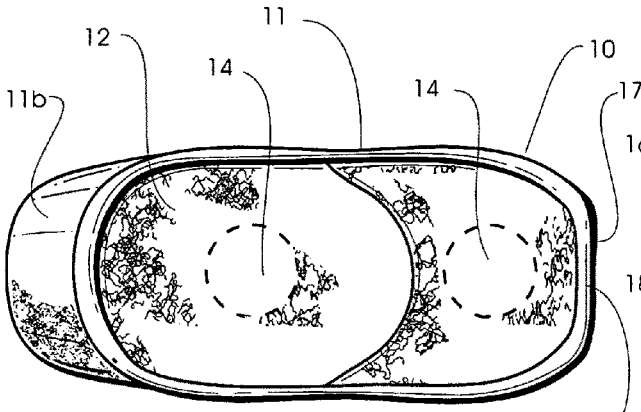
FIG. 1 is a top view of a golf club head cover in accordance with the present invention.
Figure 3:
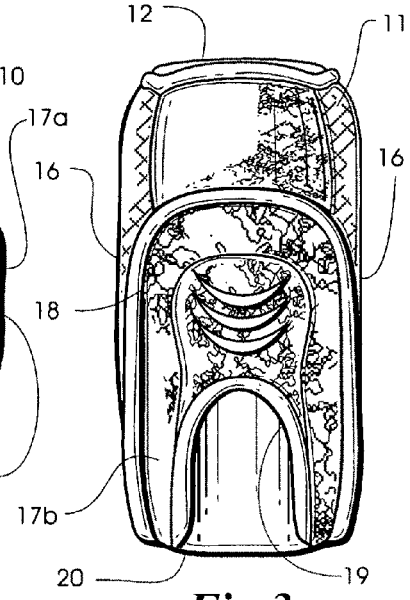
FIG. 3 is an end view of the golf club head cover of FIG. 1.
Figure 2:
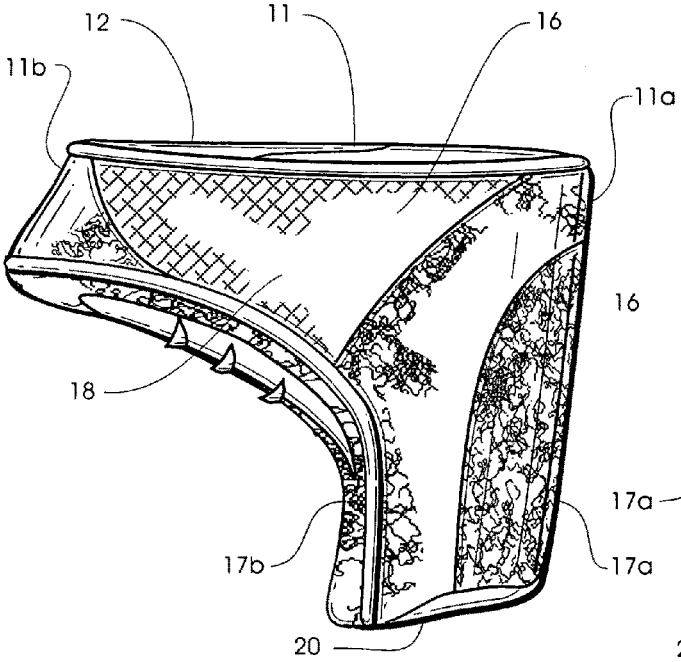
FIG. 2 is a side view of the golf club head cover of FIG. 1.
Figure 4:
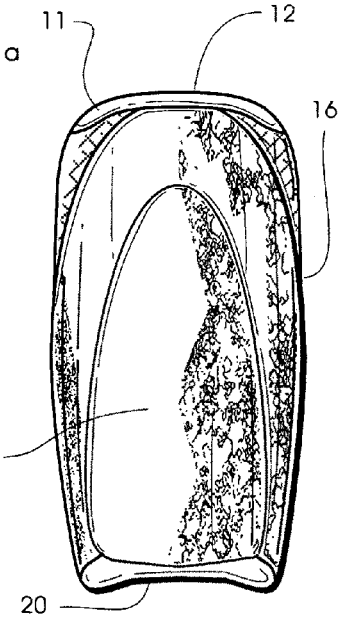
FIG. 4 is an opposite end view of the golf club head cover of FIG. 1.

Referring to FIGS. 1 and 2, a golf club head cover 10 is sized and shaped to fit on a golf club head (not shown). The head cover 10 includes a body 11 having a bottom wall 12 with magnetic means, such as a plurality of magnets 14, secured (i.e. embedded) in the bottom wall 12. The head cover 10 also includes a pair of side walls 16 which extend from the bottom wall 12 to form a compartment 18 for containing a golf club head. The magnets 14 hold the head cover 10 on the club head when the club head is contained in the compartment 18. The side walls 16 also define an opening 20 through which the club head may be inserted into or removed from the compartment 18. The opening 20 is further defined by a pair of end walls 17*a*, 17*b* extending between the side walls 16. One of the end walls 17*b* is located closer to a toe end 11*b* of the body 11 than a heel end 11*a* of the body 11. The end wall 17*b* has a substantially U-shaped opening 19 formed therein.

The bottom wall 12 and the side walls 16 may be formed from a variety of materials, such as leather, synthetic rubber, neoprene, polyethylene, polyurethane, ABS or other plastic or fabric materials. The magnets 14 facilitate use of the head cover 10 without undue manipulation thereby promoting frequent use of the head cover 10. Since the head cover 10 is held on the club head by magnetic force, no other fastening devices are needed to prevent the head cover 10 from being inadvertently removed from the club head.

In the preferred embodiment, the two magnets 14 are generally cylindrical with a thickness of about 3 mm and a diameter of about 20 mm. One magnet 14 is located adjacent the heel end 11*a* of the body 11 while the other magnet 14 is located adjacent the toe end 11*b* of the body 11. Each magnet 14 may be held in place in the bottom wall 12 by adhesives, rivets, stitching, or other conventional means. Alternatively, magnetic means of different sizes and shapes may be used instead of the magnets 14. For example, a strip of magnetic material (not shown) extending longitudinally of the bottom wall 12 may be used.

In the preferred embodiment, the head cover 10 is a putter head cover for use on a golf putter head. In other embodiments, the head cover 10 may be configured to accommodate other types of club heads such as wood heads and iron heads.

It will be understood that the magnets 14 could be secured in one or both of the side walls 16 instead of in the bottom wall 12. Also, it will be understood that the magnetic force of the magnets 14 permits a golfer to use a golf club to easily retrieve the head cover 10 without bending over.

What is claimed is:

1. A golf club head cover comprising:

a body comprising a bottom portion, a heel end, a toe end, and side portions coupled to the bottom portion; wherein the side portions extend from the bottom portion to form a generally L-shaped compartment for containing a golf club head and to define an opening opposite the bottom portion through which the golf club head can be inserted into and removed from the compartment, the opening being further defined between a pair of end portions extending between the side portions, a first end portion of the pair of end portions being located closer to the toe end of the body than to the heel end of the body, the first end portion having a substantially U-shaped opening;

and a magnetic means in the bottom portion for holding the golf club head cover on the golf club head when the golf club head is contained in the compartment, the magnetic means comprising a first magnet located adjacent the toe end and a second magnet spaced apart from the first magnet in a direction extending towards the heel end.

2. The golf club head cover of claim 1, wherein:

the first and second magnets are embedded within the bottom portion.

3. The golf club head cover of claim 1, wherein:

the first and second magnets are generally cylindrical.

4. The golf club head cover of claim 1, wherein:

the second magnet is located adjacent the heel end of the body.

5. The golf club head cover of claim 1, wherein:

the first magnet is configured to secure only a head toe portion of the golf club head; and the second magnet is configured to secure only a head heel portion of the golf club head.

6. The golf club head cover of claim 1, wherein:

the first and second magnetic elements each have a thickness of about 3 mm and a diameter of about 20 mm.

7. The golf club head cover of claim 1, wherein:

the golf club head cover is devoid of other fastening devices, besides the first and second magnetic elements, to prevent the golf club head cover from being inadvertently removed from the golf club head.

8. The golf club head cover of claim 1, wherein:

at least one of the bottom portion or the side portions comprises at least one of:

a leather material, a synthetic rubber material, a neoprene material, a polyethylene material, a polyurethane material, an ABS material, or a fabric material.

9. The golf club head cover of claim 1, wherein:

a perimeter path length of the opening is substantially fixed and configured to accommodate insertion of the golf club head.

10. The golf club head cover of claim 1, wherein:

a gap distance at the bottom portion separates the first and second magnets from each other;

the gap distance is greater than a longest dimension of at least one of the first or second magnets; and the bottom portion is non-magnetic along the gap distance.

11. The golf club head cover of claim 1, wherein:

the U-shaped opening is sized to accommodate a diameter of at least one of:

a hosel of the golf club head; or a shaft coupled to the golf club head.

12. The golf club head cover of claim 1, wherein:

the body further comprises a crown portion towards the toe end and between the side portions;

and the substantially U-shaped opening of the first end portion is located at the crown portion.

13. The golf club head cover of claim 1, wherein:

the first and second magnets are embedded within the bottom portion; and the golf club head cover is devoid of other fastening devices, besides the first and second magnetic elements, to prevent the golf club head cover from being inadvertently removed from the golf club head.

14. The golf club head cover of claim 1, wherein:

the first and second magnets each comprise:

a generally cylindrical shape;

a thickness of about 3 mm; and a diameter of about 20 mm.

15. The golf club head cover of claim 1, wherein:

the first and second magnets are embedded within the bottom portion;

the first and second magnets are generally cylindrical;

the second magnet is located adjacent the heel end of the body;

the first magnet is configured to secure only a head toe portion of the golf club head;

the second magnet is configured to secure only a head heel portion of the golf club head;

the first and second magnetic elements each have a thickness of about 3 mm and a diameter of about 20 mm;

the golf club head cover is devoid of other fastening devices, besides the first and second magnetic elements, to prevent the golf club head cover from being inadvertently removed from the golf club head;

at least one of the bottom portion or the side portions comprises at least one of:

a leather material, a synthetic rubber material, a neoprene material, a polyethylene material, a polyurethane material, an ABS material, or a fabric material;

a perimeter path length of the opening is substantially fixed and configured to accommodate insertion of the golf club head;

a gap distance at the bottom portion separates the first and second magnets from each other;

the gap distance is greater than a longest dimension of at least one of the first or second magnets;

the bottom portion is non-magnetic along the gap distance;

the U-shaped opening is sized to accommodate a diameter of at least one of:

a hosel of the golf club head; or a shaft coupled to the golf club head;

the body further comprises a crown portion towards the toe end and between the side portions; and the substantially U-shaped opening of the first end portion is located at the crown portion.

16. The golf club head cover of claim 1, wherein:

the first and second magnets are embedded within the bottom portion;

the first and second magnets are generally cylindrical;

the second magnet is located adjacent the heel end of the body;

the first magnet is configured to secure only a head toe portion of the golf club head;

the second magnet is configured to secure only a head heel portion of the golf club head;

a gap distance at the bottom portion separates the first and second magnets from each other;

the gap distance is greater than a longest dimension of at least one of the first or second magnets;

and the bottom portion is non-magnetic along the gap distance.

17. The golf club head cover of claim 1, wherein:

a perimeter path length of the opening is substantially fixed and configured to accommodate insertion of the golf club head;

the U-shaped opening is sized to accommodate a diameter of at least one of:

a hosel of the golf club head; or a shaft coupled to the golf club head;

the body further comprises a crown portion towards the toe end and between the side portions;

and the substantially U-shaped opening of the first end portion is located at the crown portion.

18. The golf club head cover of claim 1, wherein:

the golf club head cover is devoid of other fastening devices, besides the first and second magnetic elements, to prevent the golf club head cover from being inadvertently removed from the golf club head; and a perimeter path length of the opening is substantially fixed and configured to accommodate insertion of the golf club head.

19. The golf club head cover of claim 1, wherein:

a gap distance at the bottom portion separates the first and second magnets from each other;

the gap distance is greater than a longest dimension of at least one of the first or second magnets;

the bottom portion is non-magnetic along the gap distance; and the U-shaped opening is sized to accommodate a diameter of at least one of:

a hosel of the golf club head; or a shaft coupled to the golf club head.

20. The golf club head cover of claim 1, wherein:

a perimeter path length of the opening is substantially fixed and configured to accommodate insertion of the golf club head;

a gap distance at the bottom portion separates the first and second magnets from each other;

the gap distance is greater than a longest dimension of at least one of the first or second magnets;

and the bottom portion is non-magnetic along the gap distance.

* * * * *